US007896266B1

(12) United States Patent
Cooper et al.

(10) Patent No.: US 7,896,266 B1
(45) Date of Patent: Mar. 1, 2011

(54) WHEELED ATTACHMENT FOR PRESSURE WASHER

(76) Inventors: Martin L. Cooper, Fairhope, AL (US); Charles S. Houser, Magnolia Springs, AL (US)

( * ) Notice: Subject to any disclaimer, the term of this patent is extended or adjusted under 35 U.S.C. 154(b) by 0 days.

(21) Appl. No.: 12/378,374

(22) Filed: Feb. 17, 2009

Related U.S. Application Data

(60) Provisional application No. 61/138,076, filed on Dec. 16, 2008.

(51) Int. Cl.

| | |
|---|---|
| ***A62C 31/24*** | (2006.01) |
| ***B05B 15/06*** | (2006.01) |
| ***B05B 7/02*** | (2006.01) |
| ***B05B 3/00*** | (2006.01) |
| ***B05B 3/18*** | (2006.01) |

(52) U.S. Cl. ..... 239/754; 239/280; 239/280.5; 239/525; 239/532; 239/600; 134/172

(58) Field of Classification Search ..... 239/104, 239/106, 264, 280, 280.5, 375, 525, 532, 239/600, 722, 753, 754; 134/172, 174, 198; 401/289

See application file for complete search history.

(56) References Cited

U.S. PATENT DOCUMENTS

| | | | | |
|---|---|---|---|---|
| 2,692,163 | A * | 10/1954 | Geel | 239/754 |
| 2,746,072 | A * | 5/1956 | Lumpkin | 401/48 |
| 3,832,069 | A | 8/1974 | Petsch | |
| 3,931,931 | A * | 1/1976 | Otis | 239/754 |
| 4,200,236 | A * | 4/1980 | Briar | 15/361 |
| 4,887,330 | A | 12/1989 | Woodhall et al. | |
| 5,456,412 | A | 10/1995 | Agee | |
| 6,158,678 | A | 12/2000 | Lange | |
| 6,651,909 | B1 * | 11/2003 | Bugarin | 239/390 |
| 6,776,363 | B1 * | 8/2004 | Falletta et al. | 239/722 |
| 7,063,281 | B2 * | 6/2006 | Schommer | 239/754 |
| 7,217,053 | B2 * | 5/2007 | Alexander et al. | 401/139 |
| 2002/0190145 | A1 * | 12/2002 | Sheppard, Jr. | 239/754 |
| 2005/0081899 | A1 | 4/2005 | Shannon | |
| 2006/0265820 | A1 | 11/2006 | Erlich et al. | |
| 2008/0000501 | A1 | 1/2008 | Sprecher | |

* cited by examiner

*Primary Examiner*—Len Tran
*Assistant Examiner*—Ryan Reis
(74) *Attorney, Agent, or Firm*—George L. Williamson

(57) ABSTRACT

Method and apparatus for a wheeled attachment for use with a conventional pressure washer wherein the attachment comprises a wheeled platform having an inlet to receive fluid, i.e., water or cleaning fluid, from the pressure washer along with a plurality of outlets for spraying water directly onto a relatively wide area of the surface to be cleaned. The attachment is expected to be most effective for cleaning horizontal surfaces such as sidewalks, driveways, decks, docks and other horizontal surfaces. The attachment further comprises first and second height-adjustable wheels for attachment to the sides of the platform along with a splash guard disposed on the rear of the platform for protecting the user from overspray. A manifold connects the single inlet to the plurality of outlets in order to transfer fluid from the inlet to the outlets so that fluid is uniformly applied to the surface to be cleaned.

8 Claims, 4 Drawing Sheets

WHEELED ATTACHMENT FOR PRESSURE WASHER

RELATED APPLICATIONS

This application claims benefit of U.S. Provisional Patent Application Ser. No. 61/138,076 filed on Dec. 16, 2008.

BACKGROUND OF THE INVENTION

1. Field of the Invention

The present invention relates generally to pressure washers and, more particularly, is concerned with a wheeled attachment for a conventional pressure washer.

2. Description of the Prior Art

Pressure washers and attachments have been described in the prior art, however, none of the prior art devices disclose the unique features of the present invention.

In U.S. Patent Application Publication 2008/0000501 dated Jan. 3, 2008, Sprecher disclosed a pressure cleaner accessory. In U.S. Patent Application Publication 2006/0265820 dated Nov. 30, 2006, Erlich, et al., disclosed an adaptable nozzle attachment for a pool cleaner. In U.S. Patent Application Publication 2005/0081899 dated Apr. 21, 2005, Shannon disclosed an adjustable spacer attachment for a pressure washer. In U.S. Pat. No. 6,776,363 dated Aug. 17, 2004, Falletta, et al., disclosed a carriage attachment for a power washer. In U.S. Pat. No. 6,158,678 dated Dec. 12, 2000, Lange disclosed an apparatus for applying fluids to various types and locations of surfaces. In U.S. Pat. No. 5,456,412 dated Oct. 10, 1995, Agee disclosed a high pressure surface washing device. In U.S. Pat. No. 4,887,330 dated Dec. 19, 1989, Woodhall, et al., disclosed a washer attachment for a suction cleaner. In U.S. Pat. No. 3,832,069 dated Aug. 27, 1974, Petsch disclosed a cleaning apparatus.

While these pressure washers and attachments may be suitable for the purposes for which they were designed, they would not be as suitable for the purposes of the present invention as hereinafter described.

SUMMARY OF THE PRESENT INVENTION

The present invention discloses a method and apparatus for a wheeled attachment for use with a conventional pressure washer wherein the attachment comprises a wheeled platform having an inlet to receive fluid from the pressure washer along with a plurality of outlet nozzles for spraying water and/or cleaning fluid directly onto a relatively wide area of the surface to be cleaned. The present invention is expected to be most effective for cleaning horizontal surfaces such as concrete sidewalks and driveways. The present invention further comprises first and second height-adjustable wheels for attachment to the sides of the platform along with a splash guard disposed on the rear of the platform for protecting the user from overspray. A manifold connects the single inlet to the plurality of outlets in order to transfer fluid from the inlet to the outlets so that fluid is uniformly applied to the surface to be cleaned.

An object of the present invention is to allow for faster, more efficient cleaning of horizontal surfaces such as walks and driveways by allowing a relatively large area to be cleaned at any one time. A further object of the present invention is to provide a cleaning attachment which can be easily operated by the user utilizing one hand during operation. A further object of the present invention is to provide an attachment for a pressure washer that minimizes body, i.e., arm, back and leg, fatigue to the user. A further object of the present invention is to provide an attachment for a pressure washer which allows for applying fluid at different angles by simply changing hand heights on the present invention. A further object of the present invention is to provide an attachment for a pressure washer which uses standard available connections in addition to having easily interchangeable spray nozzles and related appurtenances and/or components. An additional object of the present invention is to allow a combination of cleaning properties due to the ability to make changes in the wheel height, number of spray nozzles and orifices, spray angle of individual nozzles, as well as the overall angle of the platform of the present invention.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
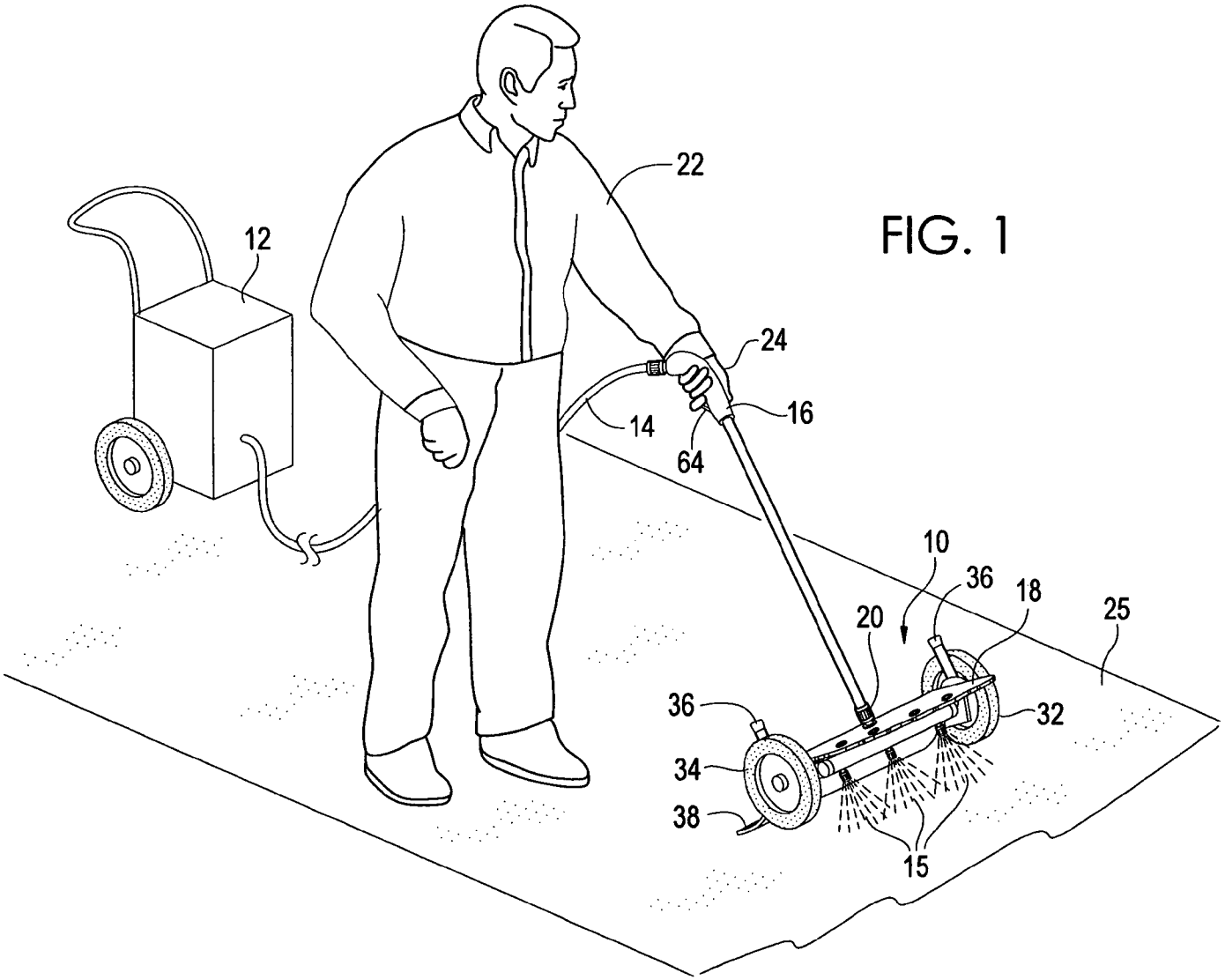
FIG. 1 is a perspective view of the present invention shown in operative connection.

With regard to reference numerals used, the following numbering is used throughout the drawings.

10 present invention
12 conventional pressure washer
14 hose
15 spray
16 handle
17 extension wand
18 platform
20 quick connect fitting
22 user
24 hand
25 surface
26 top
27 bottom
28 front
30 rear
32 first side wheel
34 second side wheel
36 height adjustment mechanism
38 splash guard
40 inlet
42 cap
44 manifold

46 outlet nozzle
47 water spray nozzle
48 quick connect fitting
50 aperture
52 axle
54 aperture
55 nut
58 apertures
59 grommet
60 manifold inlet
62 manifold outlet
64 trigger

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a wheeled attachment for a pressure washer is disclosed.

Turning to FIG. 1, therein is shown the present invention 10 for use as a wheeled attachment to a conventional pressure washer 12 being connected to the conventional pressure washer 12 through the use of a hose 14 and a gripping handle 16 having a trigger 64 thereon for controlling fluid flow wherein the distal end of the handle is attached to the upper surface of platform 18 of the present invention using an extension wand 17 having on its distal end a quick connect fitting 20. The wheels are shown at 32, 34 with height adjustment mechanism 36. A user 22 is controlling the handle 16 of the present invention 10 in his hand 24. The present invention 10 is expected to be particularly useful for cleaning horizontal surfaces 25 such as sidewalks, walkways, driveways, decks, docks, and other horizontal surfaces by applying a wide path of cleaning fluid spray 15 to surface being cleaned. Note that the spray 15 from the outlets overlaps so as to provide a wide cleaning path and eliminate streaking caused by the cleaning fluid. Also shown is splash guard 38 which may be made of many materials including rubber or like material and may be flexible.

Figure 2:
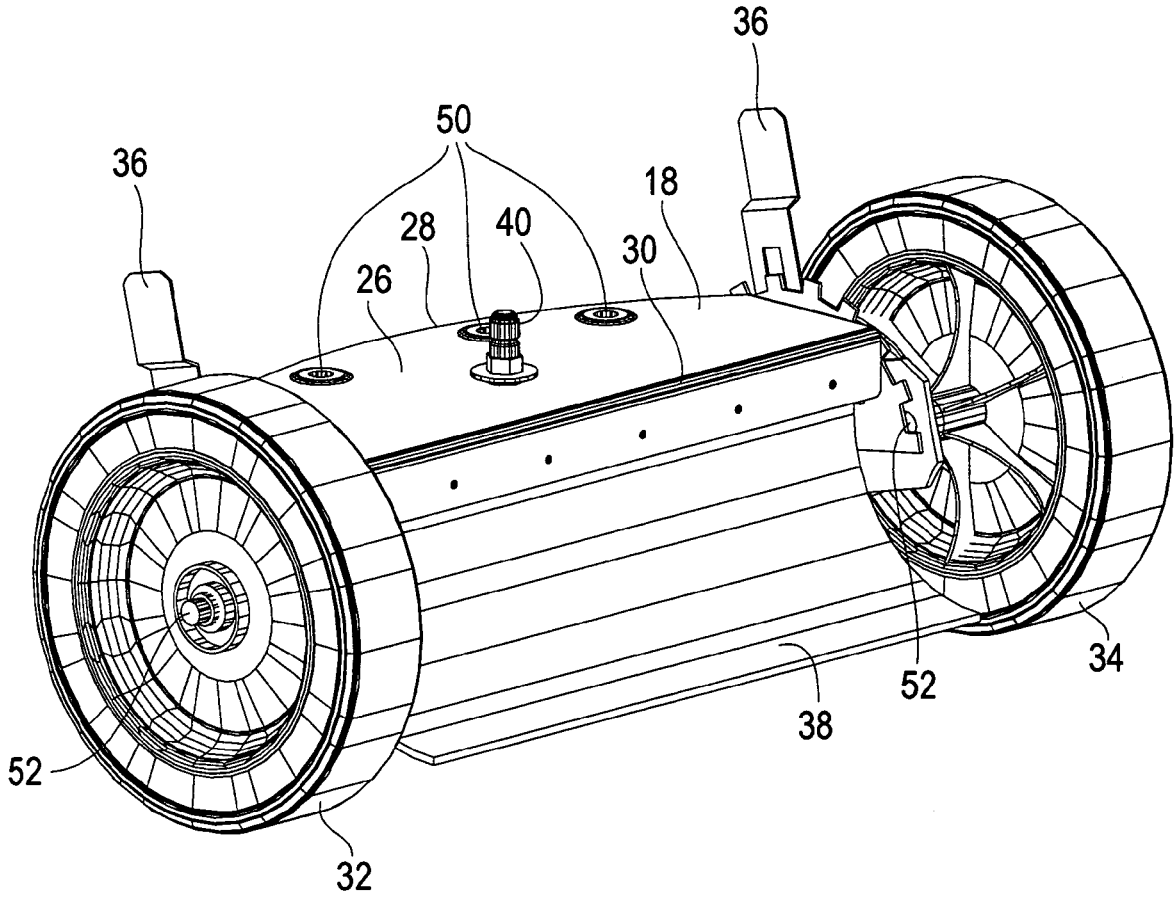
FIG. 2 is a perspective view taken from the rear of the present invention.

Turning to FIG. 2, therein is shown the present invention 10 showing the upper surface portion 26 of the platform 18 having a front 28 and a rear 30 showing a pair of wheels 32, 34 connected to the first and second sides of the platform 18. Note that each of the wheels 32, 34 is height adjustable using a conventional height adjustment mechanism 36 as would be done in the standard manner by one skilled in the art. Also shown is a flexible flap 38 disposed on the rear 30 of platform 18 extending from the platform down to the horizontal surface 24 (not shown see FIG. 1) which has the purpose of protecting the user from overspray of cleaning fluids from the present invention 10. Also shown is the male portion of inlet/coupling 40 for receiving quick connect fitting 20 (not shown see FIG. 1) which serves as the fluid inlet for the present invention 10 along with a plurality of apertures 50 which serve as a storage receptacle for spare spray nozzles and/or plugs. Also shown is axle 52 of wheel 32, 34.

Figure 3:
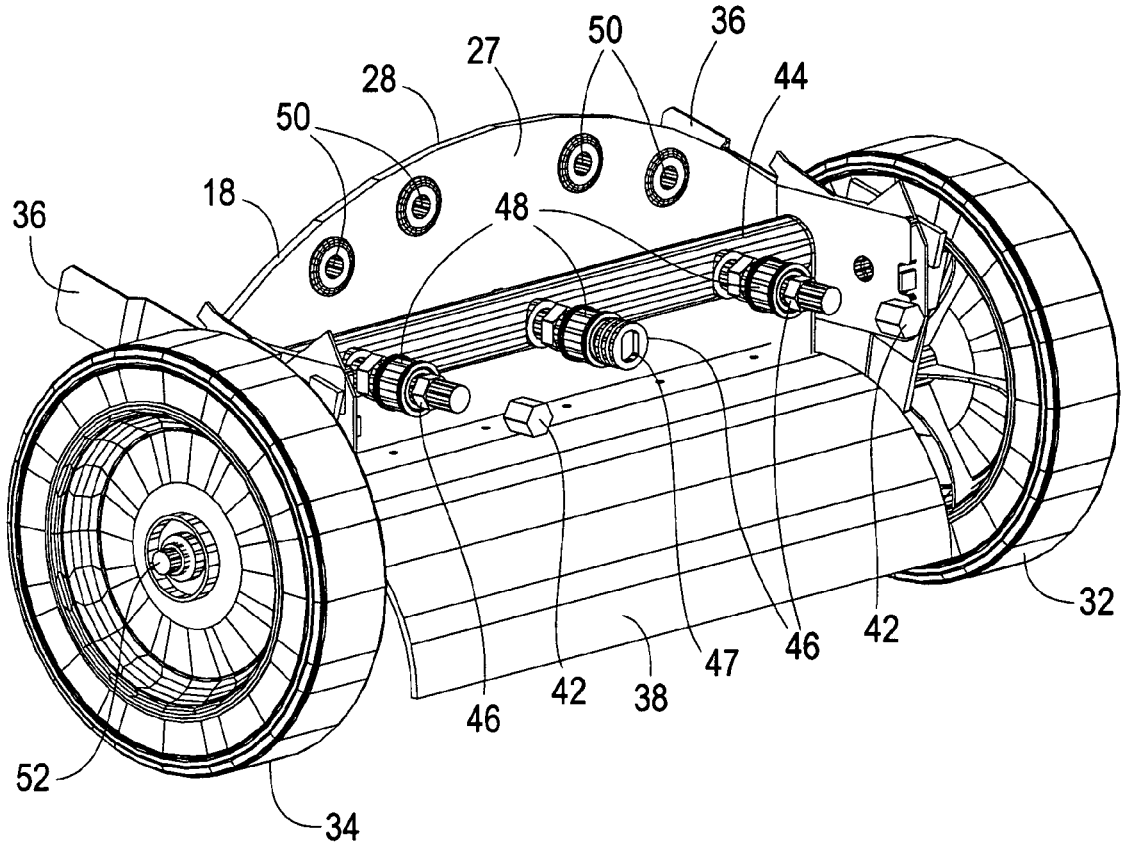
FIG. 3 is a perspective view showing the underside of the present invention.

Turning to FIG. 3, therein is shown the lower surface or underside 27 of platform 18 showing the front 28 and the plurality of storage apertures 50 which serve as a storage location for various quick disconnect fittings. Also shown are the wheels 32, 34 along with the height adjustment mechanisms 36, axle 52 and flexible flap 38. Also shown is a manifold 44 which receives water from inlet 40 (not shown, see FIG. 2) along with a plurality of spaced apart outlet spray nozzles 46 each being attached to manifold 44 through a quick connect fitting 48 which spaced apart outlet spray nozzles allow for application of a wide path of spray to the surface being cleaned. A water spray nozzle is shown at 47. Caps/plugs 42 (shown exploded for clarity) may be installed on the two outer outlet spray nozzles 46 so that only spray from the central nozzle 46 would be permitted. Any of the outlets 46 could be capped using caps/plugs 42 to suit the operational requirements of the user.

Figure 4:
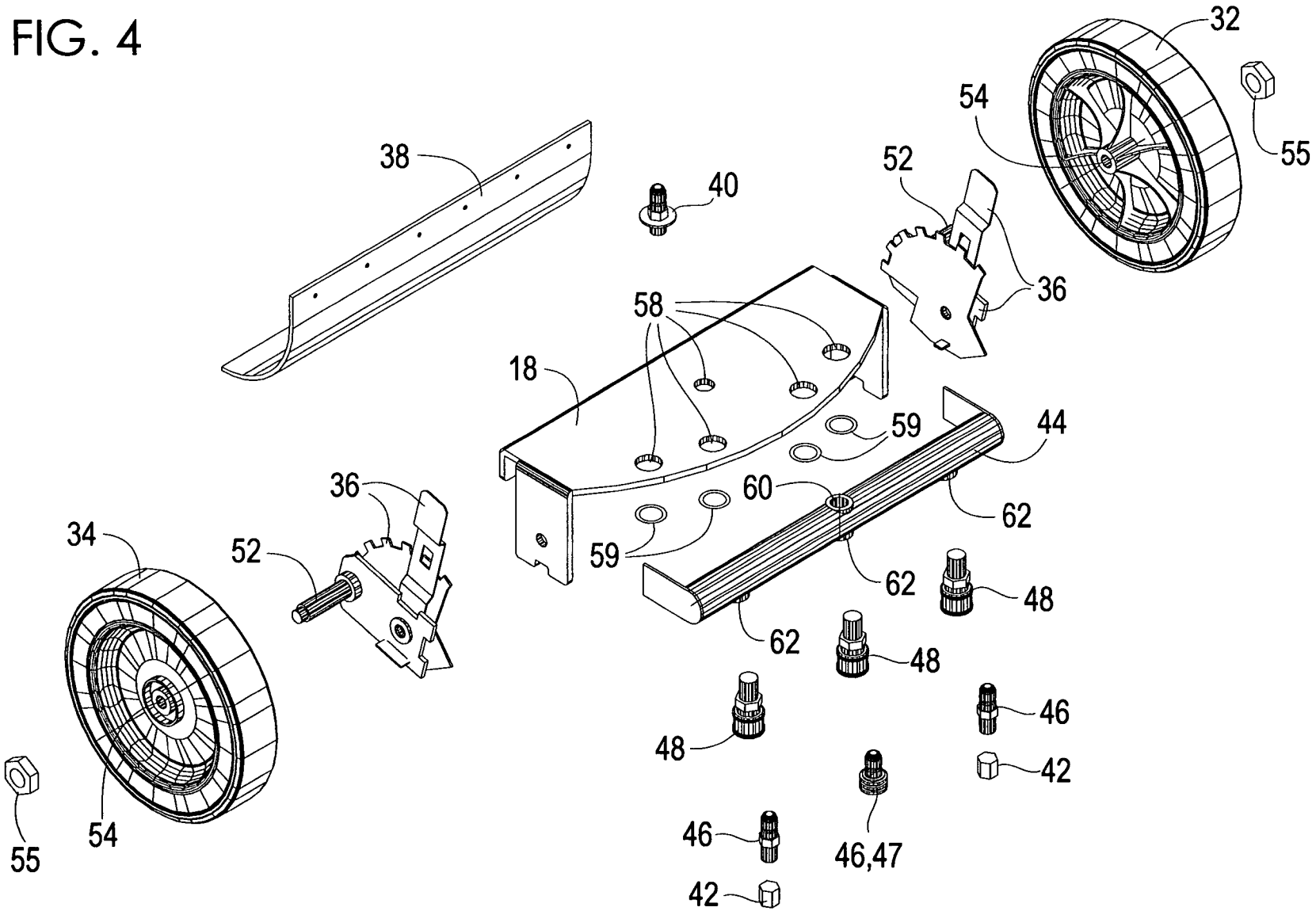
FIG. 4 is an exploded view of the present invention.

Turning to FIG. 4, therein is shown the present invention 10 comprising flexible flap 38, platform 18, a plurality of apertures 58 with rubber grommets 59 for receiving various fittings along with the inlet nozzle 40 having a pair of wheels 32, 34 thereon and wherein each wheel comprises a height adjustment mechanism 36 wherein each height adjustment mechanism has an axle 52 with nuts 55 thereon for insertion into the apertures 54 of wheels 32, 34. Also shown is the manifold 44 with threaded inlet aperture 60 having a plurality of threaded outlets apertures 62 for receiving outlet fittings 48, each having quick connect fittings thereon for receiving a plurality of outlet nozzles 46, 47 and caps/plugs 42.

We claim:

1. An apparatus for a wheeled attachment to the extension wand of a conventional pressure washer for washing a surface, an extension wand having a wand outlet thereon and a grip thereon for being grasped in the hand of a user, comprising:

a) a platform comprising a flat member, said platform having a front, a rear, a first and second side, and an upper and lower surface;

b) a height adjustment mechanism being disposed on each said first and second side of said platform for adjusting the height of said platform;

c) a wheel being disposed on each said first and second side of said platform for wheeling said platform about;

d) a manifold being disposed on and separate from said platform, said manifold having an inlet thereon and a plurality of spaced apart outlets thereon wherein said manifold extends substantially from said first side to said second side of said platform for applying cleaning fluid to the surface to be washed, wherein said cleaning fluid from said outlets overlaps;

e) wherein the wand outlet comprises a quick connect fitting and is connected to said inlet of said manifold through said platform so that fluid flows from the extension wand to said plurality of spaced apart outlets to permit the surface to be washed;

f) a splash guard comprising a flexible flap being disposed on and attached to said rear of said platform to prevent overspray from reaching a user, said flexible flap extending down to the surface being cleaned; and g) said platform having downwardly extending legs from the first and second sides thereof, respectively, said manifold being attached to and between said downwardly extending legs, and said height adjustment mechanisms being mounted on outside surfaces of said downwardly extending legs.

2. The apparatus of claim 1, wherein said inlet of said manifold is disposed on said upper surface of said platform and said plurality of spaced apart outlets are disposed on said lower surface of said platform.

3. The apparatus of claim 2, wherein each of said plurality of spaced apart outlets comprises a quick connect fitting to permit the fittings to be easily and quickly changed.

4. The apparatus of claim 3, wherein said platform has a plurality of apertures therein, said apertures for storing spare spray nozzles.

5. A method for a wheeled attachment to the extension wand of a conventional pressure washer for washing a surface, an extension wand having a wand outlet thereon and a grip thereon for being grasped in the hand of a user, comprising:

a) providing a platform having a front, a rear, a first and second side, and an upper and lower surface;

b) providing a height adjustment mechanism on the first and second side of the platform for adjusting the height of the platform;

c) providing a wheel on the first and second side of the platform for wheeling the platform about;

d) providing a separate manifold on the platform, the manifold having an inlet thereon and a plurality of spaced apart outlets thereon, wherein the manifold extends substantially from the first side to the second side of the platform for applying cleaning fluid to the surface to be washed, wherein the cleaning fluid from the outlets overlaps;

e) wherein the wand outlet is connected to the inlet of the manifold through said platform so that fluid can flow from the extension wand to the plurality of spaced apart outlets to permit the surface to be washed;

f) providing a splash guard comprising a flexible flap on the rear of the platform to prevent overspray from reaching a user, said flexible flap extending to the surface being cleaned; and g) said platform being a flat member having downwardly extending legs from the first and second sides thereof, respectively, attaching said manifold to and between said downwardly extending legs, and mounting said height adjustment mechanisms on outside surfaces of said downwardly extending legs.

6. The method of claim 5, wherein the inlet of the manifold is disposed on the upper surface of the platform and the plurality of spaced apart outlets are disposed on the lower surface of the platform.

7. The method of claim 6, wherein the inlet and the plurality of spaced apart outlets comprise a quick connect fitting to permit the fittings to be easily and quickly changed.

8. The method of claim 7, wherein the platform has a plurality of apertures therein, the apertures storing spare spray nozzles.

* * * * *